United States Patent [19]

Doss

[11] Patent Number: 4,841,416

[45] Date of Patent: Jun. 20, 1989

[54] SOLAR CHARGING LAMP

[76] Inventor: Todd Doss, 1540 Alfred La. #D, Yuba City, Calif. 95991

[21] Appl. No.: 162,883

[22] Filed: Mar. 2, 1988

[51] Int. Cl.[4] ..... F21S 9/00

[52] U.S. Cl. ..... 362/183; 362/431; 362/276; 362/387; 136/291

[58] Field of Search ..... 362/431, 253, 183, 387, 362/812, 276, 802, 190, 191, 157; 136/291; 320/2

[56] References Cited

U.S. PATENT DOCUMENTS

| | | | |
|---|---|---|---|
| 3,398,291 | 8/1968 | Zerfoss | 362/276 |
| 4,200,904 | 4/1980 | Doan | 362/183 |
| 4,232,357 | 11/1980 | Dietz | 362/431 |
| 4,234,912 | 11/1980 | Barnes et al. | 362/367 |
| 4,281,369 | 7/1981 | Batte | 362/276 |
| 4,314,198 | 2/1982 | Rogers . | |
| 4,319,310 | 3/1982 | Kingsley . | |
| 4,384,317 | 5/1983 | Stackpole | 362/276 |
| 4,433,328 | 2/1984 | Saphir et al. | 362/802 |
| 4,481,562 | 11/1984 | Hickson . | |
| 4,486,820 | 12/1984 | Baba et al. | 362/276 |

*Primary Examiner*—Ira S. Lazarus
*Assistant Examiner*—D. M. Cox
*Attorney, Agent, or Firm*—Leon Gilden

[57] ABSTRACT

A solar charging lamp is set forth wherein a twelve-volt direct current lamp is illuminated by means of a wet-cell battery recharged by solar cells integrally secured to said lamp. An optional cord for attachment to an automotive cigarette lighter is available to enable charging of an automotive battery by means of the solar cells or alternatively, illuminate the lamp during continuous overcast conditions from an auxiliary battery source, as in an automoile. A photo-electric eye is operative to automatically illuminate the light in evening hours with an optional infra-red sensor operative to activate by operation in response to physical movement proximate the infra-red sensor.

1 Claim, 3 Drawing Sheets

SOLAR CHARGING LAMP

BACKGROUND OF THE INVENTION

1. Field of the Invention

The present invention relates to illuminating devices, and more particularly pertains to a new and improved solar charging lamp post that enables efficient use of solar energy for illumination of the noted lamp post and including control means for selectively activating the illumination of the lamp post apparatus.

2. Description of the Prior Art

The use of lamp post devices and solar lamp post apparatus is well known in the prior art. As may be appreciated, these devices are generally self-contained units to effectively utilize solar energy and convert same for use in illumination. These devices have accordingly been limited in their application to provide energy for the illumination unit alone and generally are not provided with any back-up means for the illumination of the lighting apparatus. For example, U.S. Pat. No. 4,200,904 to Doan provides means for utilizing solar energy and converting same to electrical energy to provide illumination for an associated lighting and traffic signal arrangement of the associated apparatus. The Doan device is limited to a self-contained unit and fails to provide selective means for controlling the operativeness of the illumination and signal units associated with the apparatus, as opposed to the instant invention which includes both an infra-red movement sensor and a photo-cell circuit to selectively control the operativeness of the illumination apparatus.

U.S. Pat. No. 4,281,369 to Batte sets forth a solar powered lamp including a plurality of solar panels presented in an array about an associated light pole wherein commercial lines may remain connected to the light pole for augmenting power during periods of low solar activity. The Batte patent is of a relatively complexd cumbersome organization, as opposed to the instant invention.

U.S. Pat. No. 4,314,198 to Rogers setting forth a solar recharge power supply circuit for a lighting system wherein the recharger and associated elements prevent overcharging of a power source. The Rogers patent is of interest relative to a charging circuit for a solar powered system but fails to present the refinements of the instant invention and selective controls thereto, such as an infra-red movement sensor, a photo-cell operative circuit to control the lighting of the illumination means in relation to a quantity of daylight available and clearly does not set forth the auxiliary power means, such as a cord for illuminating the instant invention by an associated automobile from a cigarette lighter or conversely enable charging of an automobile's storage battery during daylight periods by utilization of the photo-voltaic array associated with the instant invention.

U.S. Pat. No. 4,319,310 issued to Kingsley sets forth a self-contained solar powered illuminating sign utilizing storage cells for the illumination of the lamps during evening hours and of interest relative to the general organization but lacking the refinements and details set forth in the instant invention of control means for the activation of the illumination means when needed.

U.S. Pat. No. 4,481,562 to Hickson sets forth a solar powered station for providing illumination including a storage battery powered signaling element, a solar generator for recharging the battery, and details to bracket assembly for housing the unit where the signaling element is exposed substantially above the solar generator to minimize obstruction therebetween. The unit is of interest relative to the general application of a solar powered signaling means but as in other prior art devices, lacks the various details and refinements of controlling the illumination, as presented in the instant invention.

As such, it may be appreciated that there is continuing need for a new and improved solar charging lamp post which addresses both the problem of effectiveness and versatility, and in this respect, the present invention substantially fulfills this need.

SUMMARY OF THE INVENTION

In view of the foregoing disadvantages inherent in the known types of solar charged illuminations devices now present in the prior art, the present invention provides an solar charging lamp post operative to accept direct current through an included storage cell or alternatively through an auxiliary source, such as an automobile including various control devices for the selective operation of the apparatus. As such, the general purpose of the present invention, which will be described subsequently in greater detail, is to provide a new and improved solar charging lamp post which has all the advantages of the prior art solar charging illumination devices and none of the disadvantages.

To attain this, the present invention comprises a vertically oriented lamp post including a storage cell underlying said lamp post integrally associated therewith housing a wet cell twelve-volt battery. A photo-cell is operative to activate an included light bulb during evening hours and additionally, an infra-red movement sensor is selectively operative to illuminate an included light bulb in response to movement proximate the lamp post. An included cord is provided with an adapter for use with an automotive storage battery to enable charging of the automotive storage battery or selectively activation of the illumination device of the instant invention, as desired.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art which are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved solar charging lamp post which has all the advantages of the prior art solar powered illumination devices and none of the disadvantages.

It is another object of the present invention to provide a new and improved solar charging lamp post which may be easily and efficiently manufactured and marketed.

It is a further object of the present invention to provide a new and improved solar charging lamp post which is of a durable and reliable construction.

An even further object of the present invention is to provide a new and improved solar charging lamp post which is susceptible of a low cost of manufacture with regard to both materials and labor, and which accordingly is then susceptible of low prices of sale to the consuming public, thereby making such solar charging lamp posts economically available to the buying public.

Still yet another object of the present invention is to provide a new and improved solar charging lamp post which provides in the apparatuses and methods of the prior art some of the advantages thereof, while simultaneously overcoming some of the disadvantages normally associated therewith.

Still another object of the present invention is to provide a new and improved solar charging lamp post which is capable of absorbing and converting solar power to charging of a direct current storage cell for subsequent use during periods of darkness.

Yet another object of the present invention is to provide a new and improved solar charging lamp post including a photo-cell for detecting and activating an illumination unit associated with the lamp post during periods of darkness and optionally utilizing an infra-red movement sensor to activate an illumination unit in response to physical movement proximate a sensor.

These together with other objects of the invention, along with the various features of novelty which charcterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 3:
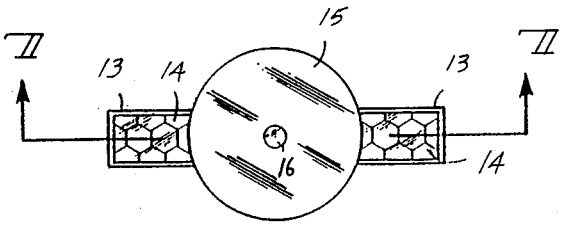
FIG. 3 is a top orthographic view of the instant invention.
Figure 1:
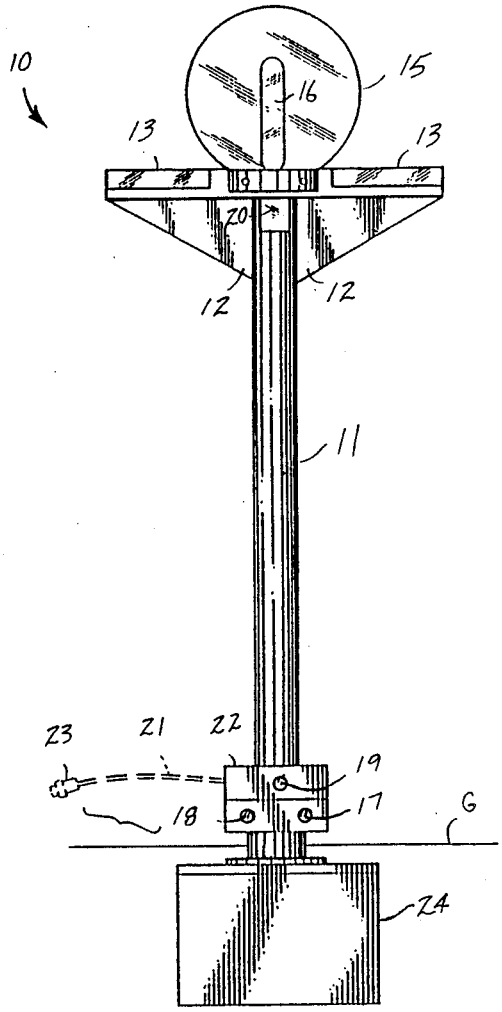
FIG. 1 is an orthographic view taken in elevation of the instant invention.
Figure 2:
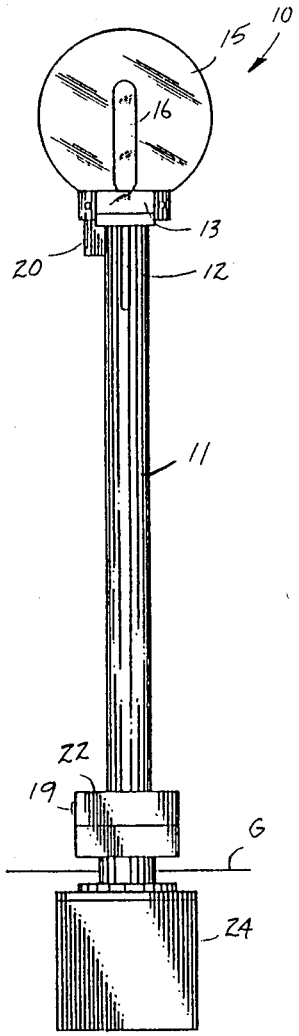
FIG. 2 is a side orthographic illustration of the instant invention.

With reference now to the drawings, and in particular to FIGS. 1 to 7 thereof, a new and improved solar charging lamp post embodying the principles and concepts of the present invention and generally designated by the reference numeral 10 will be described.

More specifically, it will be noted that the solar charging lamp post 10 essentially comprises a vertically oriented cylindrical support housing 11 securing at its upper terminal portion a pair of solar converter support brackets diametrically opposed. An elongated housing includes an overlying protective transparent lens 13 at each end of the respective support brackets 12. Secured therein, with in each lens 13, is a photovoltaic converter member 14 of conventional design for supplying DC power, as illustrated in FIG. 3, and is of rectangular configuration in conformity with the underlying housing portion.

A transparent globe 15 has secured therein an illumination bulb 16 of fifteen watt strength. It has been found that the range of wattage of the bulb 16 may vary from ten to 20 watts with fifteen watts being optimum in providing adequate illumination and longevity of the bulb 16.

At the lowermost portion of support housing 11 is a first switch 17 and a second switch 18 secured within a lowermost portion of housing 22. A photo-electric eye 19 is positioned in a desirable orientation relative to housing 22 to enable sensing of varying light conditions to effect illumination of the bulb 16 during periods of relative darkness. Switch 17 is operatively associated with photo-electric eye 19 to disengage photo-electric eye 19 from the organization wherein an infra-red movement sensor 20 is positioned in an overyling position relative to support housing 11 for detection of movement wherein in combination with a conventional timer circuit will illuminate the bulb 16 for a predetermined period of time, such as five minutes for example. The optional use of the infra-red movement sensor 20 is useful in conserving energy stored within a battery 25 positioned within battery case 24. Switch 18 is useful merely as an on/off switch to disassociate bulb 16 from the energy source during periods of desired non-use. Battery 25 is of conventional wet-cell twelve-volt configuration, as is typically found in automotive usage.

Figure 7:
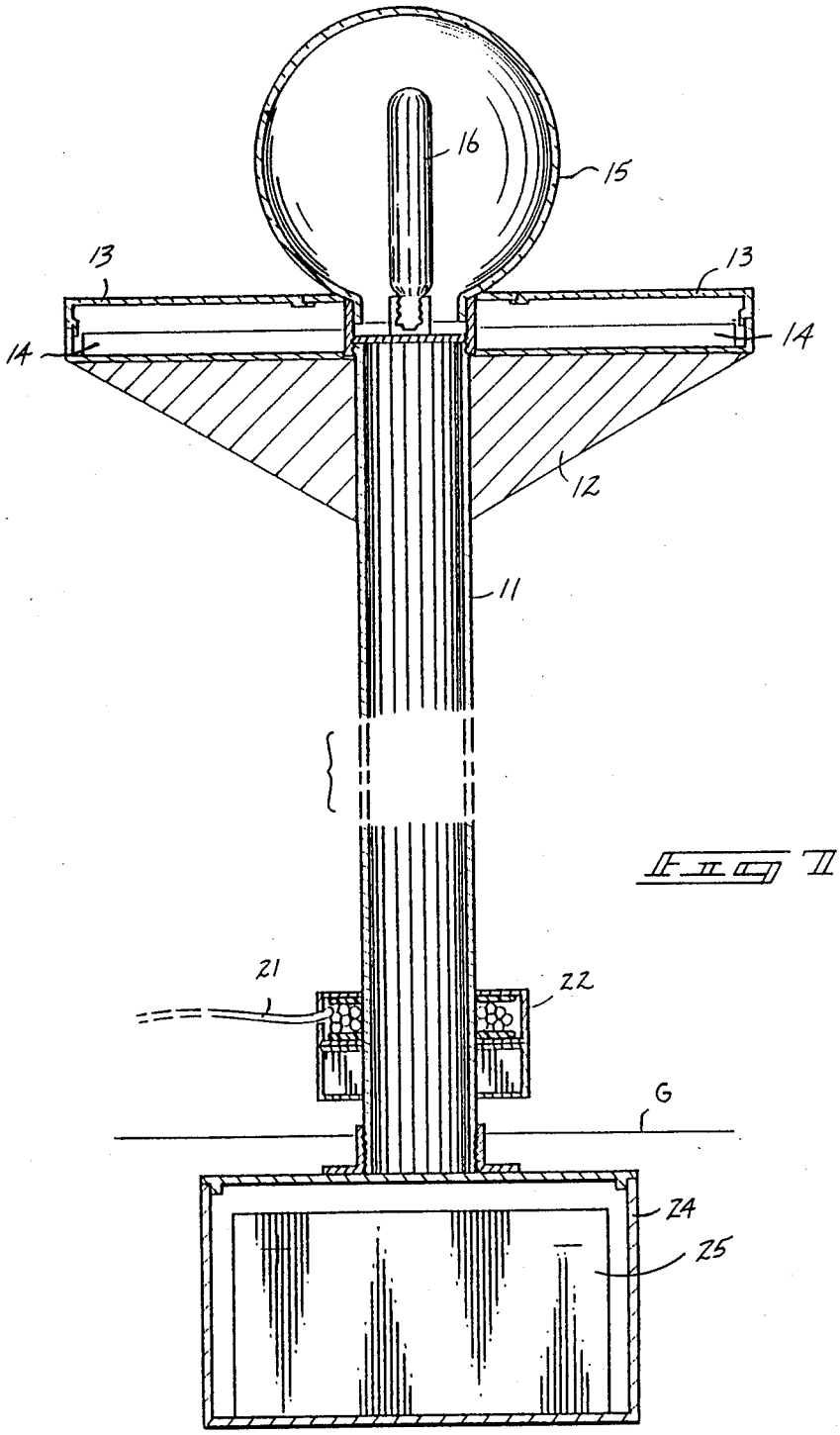
FIG. 7 is an orthographic view taken along the lines 7—7 of FIG. 3 in the direction indicated by the arrows.

As illustrated in FIG. 7, uppermost portion of housing 22 includes a cavity for securement of an electrical cord formed with an automotive cigarette lighter adapter 23 at a terminal end thereof. Withdrawal of cord 21 from housing 22 permits engagement of adapter 23 within a conventional automotive cigarette lighter and during daylight hours enables charging of the automotive storage battery by means of the photo-voltaic convertor member 14, as well as charging of the battery 25. Alternatively during extended periods of darkness preventing appropriate charging of battery 25 including three days or more of length, an auxiliary automotive battery through adapter 23 may be utilized to illuminate bulb 16, as desired.

The photo-voltaic convertor members 14 are of conventional configuration and may be employed in a circuit as set forth in U.S. Pat. No. 4,319,310 incorporated herein by reference.

Figure 6:
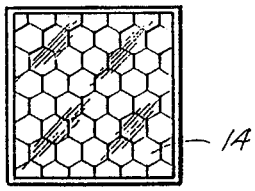
FIG. 6 is a top orthographic view of a modification of the instant invention.
Figure 4:
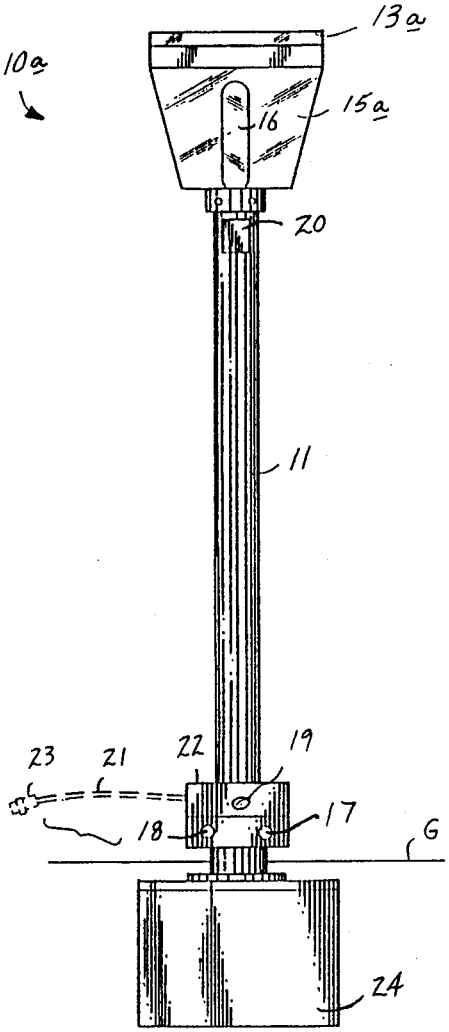
FIG. 4 is an orthographic view taken in elevation of a modification of the instant invention.
Figure 5:
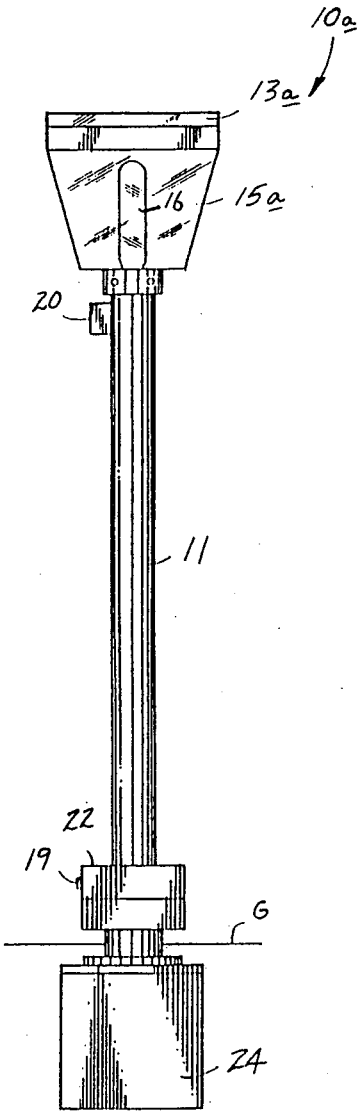
FIG. 5 is a side orthographic view taken in elevation of a modification of the instant invention.

FIGS. 4, 5, and 6 illustrates a modified solar charging lamp 10*a* with an alternative shape of the globe 15 in a polyhedral configuration 15*a* wherein a single photo-voltaic convertor member 14 is positioned overlying said globe to create a more compact structure positioned within an appropriate transparent protective lens 13*a*. This configuration is useful where surrounding free space about the solar charging lamp is limited.

Battery case 24 is secured at the lower terminal end of support housing 11 with a removable lid for service and replacement of battery 25, as is necessary. The battery within case 24, as illustrated, provides a firm securement of the apparatus 10 or 10*a* within the ground "G" and discourages unauthorized removal of the apparatus.

As to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A solar charging lamp post comprising, a vertical housing means including a transparent globe protectively containing an illumination bulb therein secured to an upper terminal end of said housing means, and photo-voltaic cell means for collecting and converting solar energy to direct current electrical energy, and a direct current storage battery secured within a battery housing means operatively associated with said photo-voltaic cell means for accepting and storing said electrical energy from said photo-voltaic cell means, and further housing means secured to said vertical housing means for storage of a length of electrical cord formed with an adaptor at one end thereof operatively associated with said photo-voltaic cell means for selective electrical association with an automobile for providing electrical energy to a storage battery within said automobile, and wherein said illumination bulb is a direct current bulb of a wattage range of ten to twenty watts, and wherein said photo-voltaic cell means are secured to brackets on said vertical housing means wherein said vertical means is cylindrical and said bracket means include a plurality of brackets diametrically opposed proximate said upper terminal end of said vertical housing means, and wherein said globe is of polyhedral configuration formed with an upper surface wherein said upper surface has positioned thereon said photo-voltaic cell, and wherein said battery housing means is secured to a lower terminal end of said vertical housing means for providing stability to the solar charging lamp post, and wherein a photo-cell is operatively associated with said bulb for enabling illumination of said bulb during periods of darkness, and wherein infra-red movement sensor is operatively associated with said photo-electric cell further including switch means for disengaging said cell and providing switching of said bulb through said infra-red movement sensor for illuminating said bulb upon sensing movement proximate said sensor.

* * * * *